US009291053B2

(12) United States Patent
Li

(10) Patent No.: US 9,291,053 B2
(45) Date of Patent: Mar. 22, 2016

(54) SELF-MOVING TUNNEL SUPPORT CANOPY

(76) Inventor: Xinbin Li, Beijing (CN)

( * ) Notice: Subject to any disclaimer, the term of this patent is extended or adjusted under 35 U.S.C. 154(b) by 0 days.

(21) Appl. No.: 14/395,511

(22) PCT Filed: Jun. 26, 2012

(86) PCT No.: PCT/CN2012/077530

§ 371 (c)(1),
(2), (4) Date: Oct. 20, 2014

(87) PCT Pub. No.: WO2013/159448

PCT Pub. Date: Oct. 31, 2013

(65) Prior Publication Data

US 2015/0086272 A1 Mar. 26, 2015

(30) Foreign Application Priority Data

Apr. 26, 2012 (CN) ..... 2012 1 0127714

(51) Int. Cl.

| | |
|---|---|
| ***E21D 9/06*** | (2006.01) |
| ***E21D 11/40*** | (2006.01) |
| ***E21D 23/04*** | (2006.01) |
| ***E21D 15/14*** | (2006.01) |
| ***E21D 23/03*** | (2006.01) |
| ***E21D 11/10*** | (2006.01) |
| ***E21D 23/06*** | (2006.01) |
| ***E21D 23/16*** | (2006.01) |
| ***E21D 23/08*** | (2006.01) |

(52) U.S. Cl.

CPC ..... *E21D 9/0621* (2013.01); *E21D 11/10* (2013.01); *E21D 11/40* (2013.01); *E21D 15/14* (2013.01); *E21D 23/03* (2013.01); *E21D 23/04* (2013.01); *E21D 23/0427* (2013.01); *E21D 23/06* (2013.01); *E21D 23/08* (2013.01); *E21D 23/16* (2013.01)

(58) Field of Classification Search

CPC ..... E21D 9/0621; E21D 23/03; E21D 23/08; E21D 23/0427; E21D 15/14; E21D 11/40

USPC ..... 405/150.1, 291

See application file for complete search history.

(56) References Cited

U.S. PATENT DOCUMENTS 317,338 A * 5/1885 Goodridge, Jr. ..... 405/150.1

FOREIGN PATENT DOCUMENTS

| | | | |
|---|---|---|---|
| CN | 2076159 | U | 5/1991 |
| CN | 101082280 | A | 12/2007 |
| CN | 201460910 | U | 5/2010 |

(Continued)

OTHER PUBLICATIONS

International Search Report for PCT/CN2012/077530 dated Feb. 7, 2013.

*Primary Examiner* — Tara M. Pinnock

(74) *Attorney, Agent, or Firm* — Ishimaru & Associates LLP

(57) ABSTRACT

A self-moving tunnel support canopy includes front arch frame, rear arch frame, forward jack, and support jack disposed under the front arch frame. The front arch frame has front arch beams and front longitudinal beams longitudinally disposed along arch upper surfaces of front arch beams and coupled to all the front arch beams. The rear arch frame has rear arch beams and rear longitudinal beams longitudinally disposed along arch upper surfaces of the rear arch beams and coupled to all the rear arch beams. The front longitudinal beams and the rear arch beams are spacedly disposed, and a spacing is configured between the front arch beam and a front-adjacent rear arch beam. One end is coupled to the front arch frame, and the other end of the forward jack is coupled to the rear arch frame. The front arch beam and the rear arch beam are both arch-shaped beams.

15 Claims, 11 Drawing Sheets

(56) References Cited

FOREIGN PATENT DOCUMENTS

| | | | |
|---|---|---|---|
| CN | 201671636 | U | 12/2010 |
| CN | 201953385 | U | 8/2011 |
| CN | 202544887 | U | 11/2012 |
| KR | 20080075995 | A | 8/2008 |
| SU | 1370251 | A1 | 1/1988 |

* cited by examiner

SELF-MOVING TUNNEL SUPPORT CANOPY

CROSS-REFERENCE TO RELATED APPLICATION

This application is the National Stage of International Application No. PCT/CN2012/077530, filed Jun. 26, 2012, which claims priority from Chinese Patent Application No. 201210127714.X, filed Apr. 26, 2012, which is incorporated herein by reference in its entirety.

TECHNICAL FIELD

The present invention relates to the fields of transportation, hydro engineering, and municipal tunnel excavation engineering, and in particular, to a self-moving tunnel support canopy.

BACKGROUND

In the prior art, a shield tunnelling machine is used to excavate a tunnel. However, due to restrictions of various conditions, during construction of a mountain tunnel, blasting construction and routine support method are mainly used.

In known arch tunnels, the applied support device may be a steel arch frames, wherein the steel arch frame is formed by circular steel tubes or I-shaped steels that are bent to an arch shape, which is used to support wall rock. The support device may be also a longitudinal disposed steel tube having a length of 10 meters to 45 meters. The steel tubes are arranged in an arch shape on three sides of the wall rock, thereby forming a tube canopy which achieving a function of advanced supporting. In addition, other support means such as an anchor rod and wood canopy or the like may also be employed.

During implementation of the present invention, the inventor has identified that the prior art has at least the following problem: Conventional support device and method are time and manpower consuming and achieve poor safety, thereby affecting the progress of the construction. Incidents regarding safety are mainly due to these poor support methods and devices. In addition, the self-moving function is not implemented for the support device.

SUMMARY

In view of the above raised defects in the prior art, embodiments of the present invention are directed to providing a self-moving, time and manpower-saving, and safe and reliable tunnel support canopy.

To achieve the above objective, the present invention employs the following technical solutions:

A self-moving tunnel support canopy, comprises a front arch frame, a rear arch frame, a forward jack, and a support jack; wherein: the front arch frame comprises more than three front longitudinal beams and more than three front arch beams, all the front longitudinal beams being longitudinally disposed along arch upper surfaces of the front arch beams, each of the front longitudinal beams being coupled to all the front arch beams, the support jack being disposed at a lower part of the front arch frame; the rear arch frame comprises more than three rear longitudinal beams and more than three rear arch beams, all the rear longitudinal beams being longitudinally disposed along arch upper surfaces of the rear arch beams, each of the rear longitudinal beams being coupled to all the rear arch beams, the support jack being disposed at a lower part of the rear arch frame, the front longitudinal beams and the rear longitudinal beams being disposed alternately, and a spacing being configured between the front arch beam and a front-adjacent rear arch beam; and one end of the forward jack is coupled to the front arch frame, and the other end of the forward jack is coupled to the rear arch frame, the front arch beam and the rear arch beam being both arch-shaped beams.

The front arch beam comprises a first semi-arch beam and a second semi-arch beam, the first semi-arch beam and the second semi-arch beam being oppositely disposed to form an arch beam, the first semi-arch beam being coupled to the second semi-arch beam via a coupling member, the coupling member being capable of enabling the first semi-arch beam and the second semi-arch beam to contract towards inner sides thereof, or extend towards outer sides thereof at a specific angle under action of an external force; and the front arch beam is of the same structure as the rear arch beam.

The coupling member is a spring board, an intermediate portion at an upper end of the first semi-arch beam is provided with an opening, and an intermediate portion at an upper end of the second semi-arch beam is provided with an opening, one end of the spring board being inserted into the opening at the intermediate portion of the first semi-arch beam, the other end of the spring board being inserted into the opening at the intermediate portion of the second semi-arch beam, and the spring board being fixedly coupled to the first semi-arch beam and the second semi-arch beam via a pin shaft.

The coupling member is a first hinge.

The coupling member comprises an intermediate beam and two hinges, one end of the intermediate beam being coupled to the first semi-arch beam via one hinge, and the other end of the intermediate beam being coupled to the second semi-arch beam via the other hinge.

Arch inner sides of the first semi-arch beam and the second semi-arch beam are provided with a telescopic beam, one end of the telescopic beam being coupled to the first semi-arch beam and the other end of the telescopic beam being coupled to the second semi-arch beam.

The telescopic beam comprises a small lateral beam and a large lateral beam, one end of the small lateral beam being inserted inside the large lateral beam, and the other end of the small lateral beam being coupled to a hinge seat on the inner side of the first semi-arch beam via a hinge; and the telescopic beam is internally provided with a lateral jack, one end of the lateral jack being hinged to the small lateral beam, the other end of the lateral jack being hinged to the large lateral beam, one end of the large lateral beam being coupled to a hinge seat on the inner side of the second semi-arch beam via a hinge.

The telescopic beam comprises a first slant support jack and a second slant support jack, one end of the first slant support jack being coupled to a hinge seat on the inner side of the first semi-arch beam via a hinge, the other end of the first slant support jack being coupled to a double-hinge seat, the double-hinge seat being coupled to the coupling member, one end of the second slant support jack being coupled to a hinge seat on the inner side of the second semi-arch beam, and the other end of the second slant support jack being coupled to the double-hinge seat.

Side wing beams are provided on downward extension portions at two ends of both the front arch beam and the rear arch beam, the side wing beams being each provided with a side-wall protection beam.

One end of the forward jack is coupled to the front arch beam, and the other end of the forward jack is coupled to the rear arch beam; and the support jack is disposed below the sides of front arch beam and the rear arch beam.

When the front arch frame and the rear arch frame are disposed in parallel, the front longitudinal beams and the rear longitudinal beams that are disposed in parallel are divided into at least two groups of longitudinal beams, the at least two groups of longitudinal beams at least comprising a group of step-like longitudinal beams formed by two groups of longitudinal beams, each group of longitudinal beams at least comprising one front longitudinal beam and one rear longitudinal beam.

Further, the self-moving tunnel support canopy comprises at least three groups of longitudinal beams, the front longitudinal beam and the rear longitudinal beam disposed in parallel at the uppermost end form a first group of longitudinal beams, the other groups of longitudinal beams are symmetrically disposed on two sides of the first group of longitudinal beams with the first group of longitudinal beams as a center of symmetry, front ends of the first group of longitudinal beams are the longest, and front ends of each of the groups of longitudinal beams on the two sides are gradually shortened to form a step-like structure.

The technical solutions provided in the embodiments of the present disclosure achieve the following beneficial effects:

The support canopy according to the present invention is capable of moving by itself, which may support the arch top and two side walls under the weak wall rock, provides uninterrupted support force against the top portion and the two side walls, and timely supports the arch top which is exposed just upon blasting. In addition, the support canopy according to the present invention not only supports the arch top portion, but also supports the two side walls, achieving an effect of securely supporting the entire slip surface. With the support canopy, the supported arch tunnel is prevented from caving and collapse. The support canopy is time and manpower saving, and safe and reliable. In addition to retaining the current traditional tunnel excavation construction process "step method construction process", the support canopy according to the present invention provides effective and convenient support and guarding for the wall rock on step-like top portion.

BRIEF DESCRIPTION OF THE DRAWINGS

To describe the technical solutions in the embodiments of the present invention more clearly, the accompanying drawings for illustrating the embodiments are briefly described below. Apparently, the accompanying drawings in the following description illustrate only some embodiments of the present invention, and persons of ordinary skill in the art may derive other accompanying drawings based on these accompanying drawings without any creative efforts.

REFERENCE SIGNS AND DENOTED PARTS OR ELEMENTS

1—front arch frame; 10—front longitudinal beam, 11—front arch beam, 110—first semi-arch beam, 111—second semi-arch beam, 112—intermediate beam, 12—cushion block;

2—rear arch frame, 20—rear longitudinal beam, 21—rear arch beam;

3—forward jack;

4—support jack;

5—spring board;

6—first hinge;

7—telescopic beam, 70—small lateral beam, 71—large lateral beam, 72—lateral jack, 73—first slant support jack, 74—second slant support jack, 75—double-hinge seat;

8—hinge seat on the inner side of the first semi-arch beam; 9—hinge seat on the inner side of the second semi-arch beam; 13—top portion; 14—side top; 15—side wall; 16—wall rock; 17—side wing beam; 18—side-wall protection beam; 19—hinge; 100—first group of longitudinal beams.

DETAILED DESCRIPTION

To make the objectives, technical solutions, and advantages of the present invention clearer, embodiments of the present invention are described in detail below with reference to the accompanying drawings.

Figure 1:
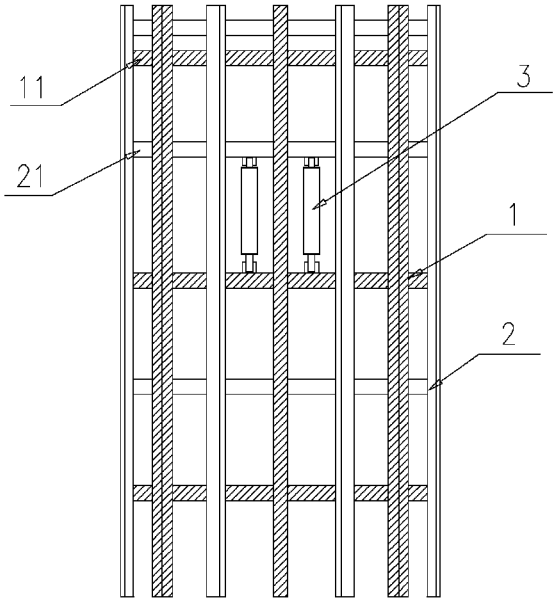
FIG. 1 is a top view of a self-moving tunnel support canopy according to an embodiment of the present invention.
Figure 2:
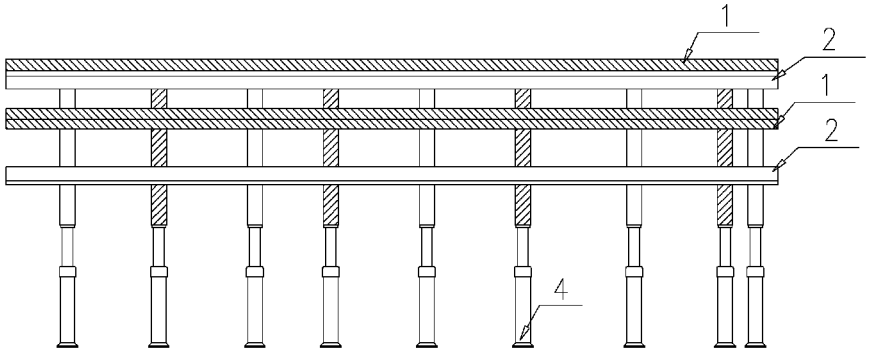
FIG. 2 is a side view of an elongated self-moving tunnel support canopy according to an embodiment of the present invention.
Figure 3:
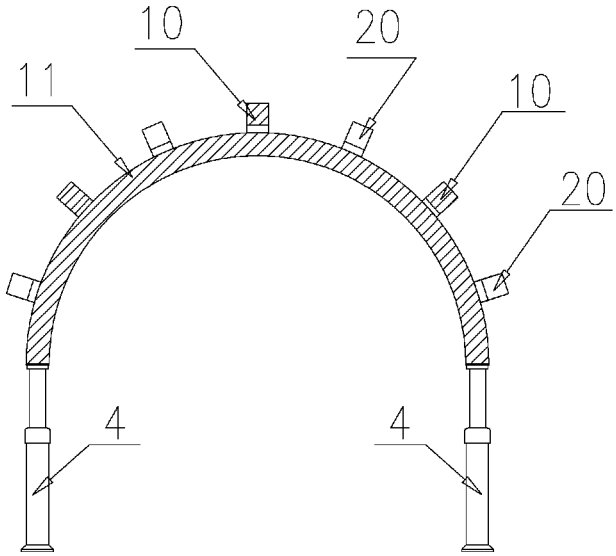
FIG. 3 is a front view of a self-moving tunnel support canopy according to an embodiment of the present invention.

Referring to FIG. 1, FIG. 2, and FIG. 3, a self-moving tunnel support canopy comprises a front arch frame 1, a rear arch frame 2, a forward jack 3, and a support jack 4. The front arch frame 1 comprises more than three front longitudinal beams 10 and more than three front arch beams 11, wherein all the front longitudinal beams 10 are longitudinally disposed along arch upper surfaces of the front arch beams 11 at an equal interval, each of the front longitudinal beams 10 is coupled to all the front arch beams 11, a cushion block 12 is disposed at each of the joints of the front longitudinal beams 10 and the front arch beams 11 and is integrally fixed thereto, and the support jack 4 is disposed at a lower part of the front arch frame 1. The rear arch frame 2 comprises more than three rear longitudinal beams 20 and more than three rear arch beams 21, wherein all the rear longitudinal beams 20 are longitudinally disposed along arch upper surfaces of the rear arch beams 21 at an equal interval, each of the rear longitudinal beams 20 is coupled to all the rear arch beams 21, a cushion block 12 is disposed at each of the joints of the rear longitudinal beams 20 and the rear arch beams 21 and is integrally fixed thereto, and the support jack 4 is disposed at a lower part of the rear arch frame 2, the front longitudinal beams 10 and the rear longitudinal beams 20 are disposed alternately, and a spacing is configured between the front arch beam 11 and a front-adjacent rear arch beam 21, the spacing being a distance for one-time forward of the front arch frame 1. One end of the forward jack 3 is coupled to the front arch frame 1, and the other end of the forward jack 3 is coupled to the rear arch frame 2, the front arch beam 11 and the rear arch beam 21 being both arch-shaped beams.

Figure 4:
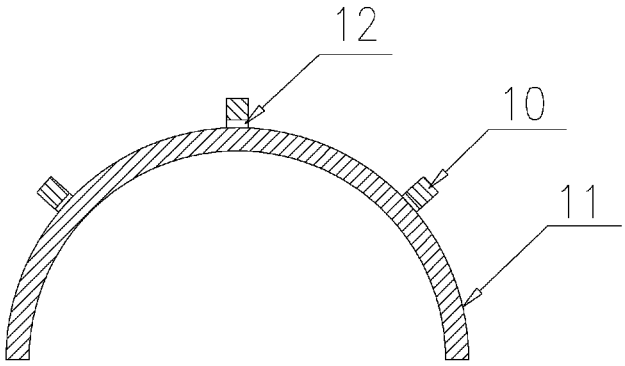
FIG. 4 is a schematic structural view of a front arch frame according to an embodiment of the present invention.
Figure 5:
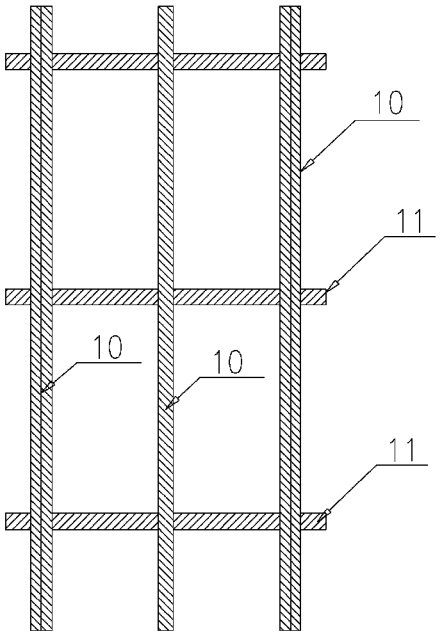
FIG. 5 is a top view of FIG. 4.
Figure 6:
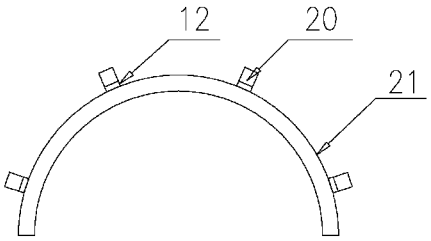
FIG. 6 is a schematic structural view of a rear arch frame according to an embodiment of the present invention.
Figure 7:
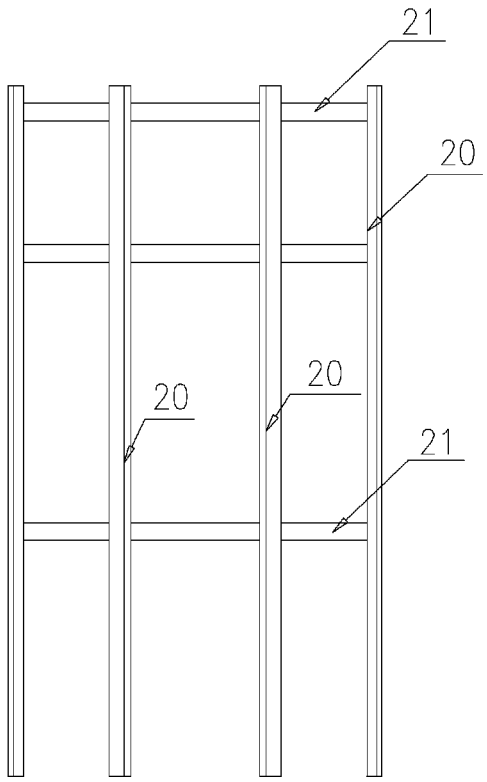
FIG. 7 is a top view of FIG. 6.

The front arch frame according to the present invention comprises more than three front arch beams bent to an arch shape, wherein the front arch beams are longitudinally disposed in a row, and several front longitudinal beams are longitudinally disposed on the peripheries of the front arch beams. A cushion block 12 is configured at each of the joints of the front arch beams and the front longitudinal beams, wherein the length and width of the cushion block 12 are the width of the front longitudinal beam, and the thickness of the cushion block 12 is around 60 mm. After the front arch beams, the front longitudinal beams, and the cushion blocks are fixed to each other based on the above arrangement, a three-dimensional front arch frame structure is formed (referring to FIG. 4 and FIG. 5). The rear arch frame structure is as illustrated in FIG. 6 and FIG. 7. The frame form thereof is the same as that of the front arch frame. The front arch frame and the rear arch frame are crosswise superposed in a manner of mutually occupying a gap thereof, and reassembled together. In the reassembled the front and rear arch frame structure, the front and rear arch frames are not fixed relative to each other, and form separate bodies. A one-cushion-block-thick movement margin in the left, right, top and bottom directions may be allowed between the frames. In the front and rear directions (i.e., a longitudinal direction), a distance is presented in the gap formed between the front end of a previous front arch beam and a rear arch beam. This distance is a distance at which a front arch frame may be separated from a rear arch frame, and is also a forward step distance of the support canopy.

Referring to FIG. 1 and FIG. 2, preferably, one end of the forward jack 3 is coupled to the front arch beam 11 and the other end of the forward jack 3 is coupled to the rear arch beam 21; and the support jack 4 is disposed at a lower part at two ends of the front arch beam 11 and the rear arch beam 21.

Optionally, one end of the forward jack 3 may be coupled to the front longitudinal beam 10 and the other end of the forward jack 3 may be coupled to the rear longitudinal beam 20.

The assembled front arch frame and rear arch frame according to the present invention are capable of moving forward sequentially under action of extension and contraction of the forward jack, providing uninterrupted support for the wall rock at the top portion of the arch tunnel. The support surface of the support canopy according to the present invention is of an arch shape, which is also applicable to a profile line and suitable for supporting various arc-shaped working surfaces of the tunnel, achieves a good support effect, and is time and manpower saving, and safe and reliable.

Figure 8:
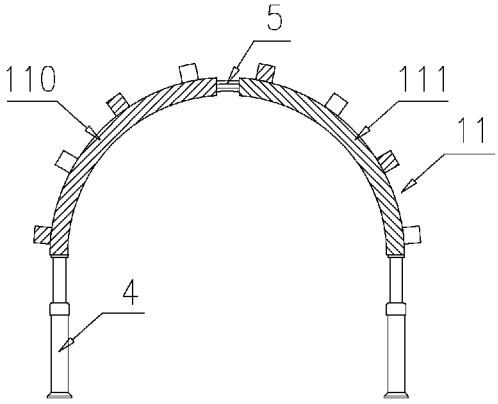
FIG. 8 is a schematic structural view of a self-moving tunnel support canopy with a spring board according to an embodiment of the present invention.

Referring to FIG. 8, the front arch beam 11 comprises a first semi-arch beam 110 and a second semi-arch beam 111, wherein the first semi-arch beam 110 and the second semi-arch beam 111 are oppositely disposed to form an arch beam, the first semi-arch beam 110 is coupled to the second semi-arch beam 111 via a coupling member, the coupling member being capable of enabling the first semi-arch beam 110 and the second semi-arch beam 111 to contract towards inner sides thereof or extend towards outer sides thereof at a specific angle under action of an external force; and the front arch beam 11 is of the same structure as the rear arch beam 12.

Preferably, the coupling member is a spring board 5, an intermediate portion of an upper end of the first semi-arch beam 110 is provided with an opening, and an intermediate portion of an upper end of the second semi-arch beam 111 is provided with an opening, wherein one end of the spring board 5 is inserted into the opening of the upper end of the first semi-arch beam 110, the other end of the spring board 5 is inserted into the opening of the upper end of the second semi-arch beam 111, and the spring board 5 is fixedly coupled to the first semi-arch beam 110 and the second semi-arch beam 111 via a pin shaft.

The self-moving tunnel support canopy according to the present invention, under action of an upright force supporting the support jack, provides support for the wall rock on the top of the tunnel. As the arch structure extends towards the two ends thereof and gradually goes downwardly on the two sides, the support force given against the side top is reduced. To increase the support force against the side top to control collapse of the wall rock on the side top, the present invention cuts off the intermediate portion of the entire arch beam, and configures a spring structure, such that the arch beam extends outwardly at a specific angle under action of an external force, wherein changes of the angle cause changes of the distance. When the support jack supports the lower end of the arch beam, the arch beam tends to extend outwardly, which provides sufficient support force against the side top. The spring board according to the present invention functions such that the arch tunnel support canopy achieves an effect of providing a support force against 50% of the area of the wall rock of the entire tunnel.

Preferably, the coupling member may also be a first hinge 6.

Configuration of the first hinge also enables the left and right wings of the arch beam to contract towards the inner side thereof or extend toward the outer side thereof at a specific angle under action of an external force, thereby giving sufficient support force against the side top and achieving more safety and reliability.

Figure 9:
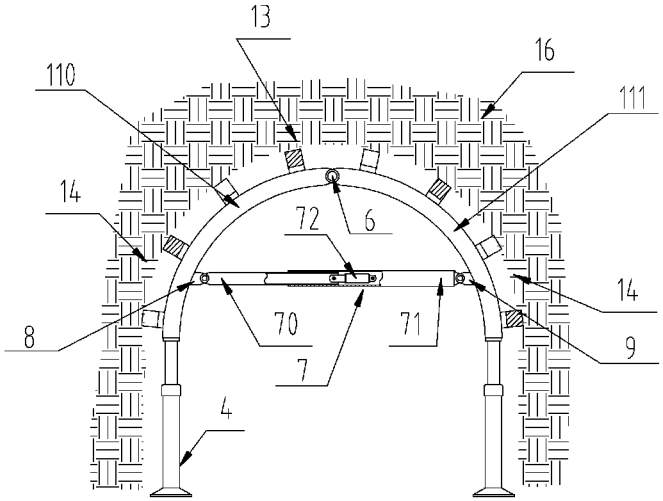
FIG. 9 is a schematic structural view of a self-moving tunnel support canopy with a telescopic bream structure according to an embodiment of the present invention.

Referring to FIG. 9, this embodiment is based on the above embodiment. In this embodiment, arch inner sides of the first semi-arch beam 110 and the second semi-arch beam 111 are provided with a telescopic beam 7, wherein one end of the telescopic beam 7 is coupled to the first semi-arch beam 110 and the other end of the telescopic beam 7 being coupled to the second semi-arch beam 111.

The support jack provides an upward support force against the top, and the lateral telescopic beam also provides a lateral support force against the side top, such that the support canopy achieves good control support and stability.

Preferably, the telescopic beam 7 comprises a small lateral beam 70 and a large lateral beam 71, wherein one end of the small lateral 70 beam is inserted inside the large lateral beam 71, and the other end of the small lateral beam 70 is coupled to a hinge seat 8 on the inner side of the first semi-arch beam 110 via a hinge; and the telescopic beam 7 is internally provided with a lateral jack 72, wherein one end of the lateral jack 72 is hinged to the small lateral beam 70, the other end of the lateral jack 72 is hinged to the large lateral beam 71, and one end of the large lateral beam 71 is coupled to a hinge seat 9 on the inner side of the second semi-arch beam 111 via a hinge. The small lateral beam and the large lateral beam are shaped steel or structural steel having hollow.

The present invention achieves an effect of supporting all the top portions of the tunnel. To enhance the support force on the two side tops of two wings of wall rock 16, applied by the support canopy, and improve the stability of the support canopy, a lateral support force needs to be provided. According to the present invention, a hinge is provided at an intermediate position of the arch beam, such that the support beams on the two wings of the arch beam is rotatable around the hinge, and forms a frame structure that is capable of moving inwardly or outwardly at a specific angle. A lateral telescopic beam is provided between the two wings of the arch beam, that is, a telescopic beam, and a hydraulic jack is internally provided, such that the lateral beam is capable of extending and contracting. When the lateral beam contacts, the arch beams on the two wings moves inwardly and then is detached from the support against the side tops, and slides forward under a small fraction resistance. When the lateral beam extends, the lateral beam moves outwardly to support two side tops 14, such that the two wings, under action of the support force, prevents the wall rock on the side tops from collapse. The structure of the hinge plus the lateral jack according to the present invention provides a horizontal lateral force, and provides a support force for the side tops on the two wings of the support canopy. This improves the stability of the support canopy. In this way, even when the support jack is temporarily removed, the support canopy can be stabilized merely under action of the force given by the lateral jack. Therefore, the arch support canopy further configured with the telescopic beam is not subjected to collapse. The arch support canopy according to the present invention not only is capable of self-moving, but also implements an arch top board providing actively support of the three sides of the tunnel. In addition, an uninterrupted support force is provided for the three sides. In this way, the structure according to the present invention is applicable to a tunnel with crushed wall rock giving a great pressure.

Figure 10:
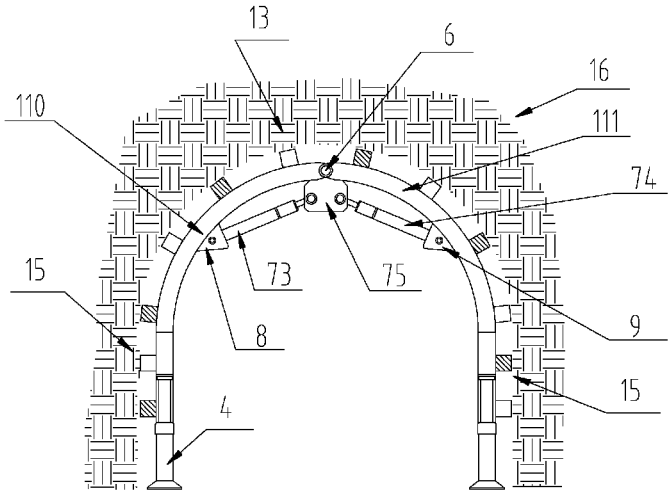
FIG. 10 is a schematic structural view of a self-moving tunnel support canopy with another telescopic bream structure according to an embodiment of the present invention.

Referring to FIG. 10, the telescopic beam structure according to the present invention may also be replaced by two slant support jack structures, wherein the two slant support jack structures comprise a first slant support jack 73 and a second slant support jack 74. One end of the first slant support jack 73 is coupled to the hinge seat 8 on the inner side of the first semi-arch beam 110 via a hinge, and the other end of the first slant support jack 73 is coupled to a double-hinge seat 75, wherein the double-hinge seat 75 is coupled to the first hinge 6. One end of the second slant support jack 74 is coupled to the hinge seat 9 on the inner side of the second semi-arch beam 111 via a hinge, and the other end of the second slant support jack 74 is coupled to the double-hinge seat 75.

A telescopic mechanism of the slant support jack of the telescopic beam moves upwards in terms of position, such that a transportation vehicle to pass through below the support canopy has a very large margin in terms of height.

Figure 11:
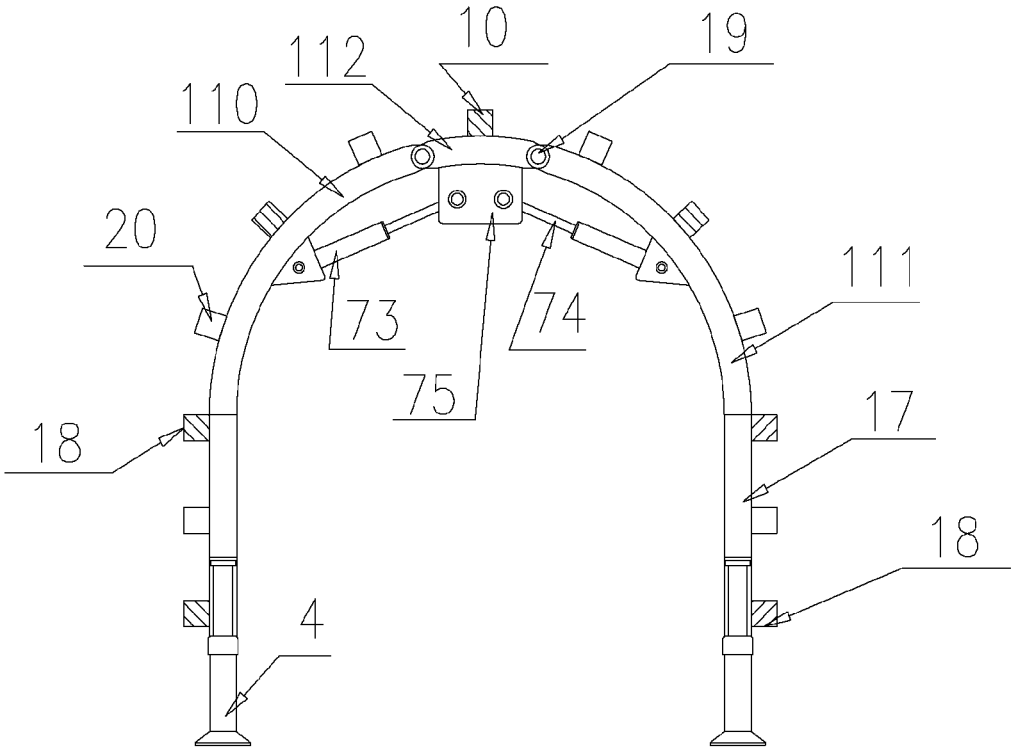
FIG. 11 is a schematic structural view of a self-moving tunnel support canopy with still another telescopic bream structure according to an embodiment of the present invention.

Referring to FIG. 11, the coupling member comprises an intermediate beam 112 and two hinges 19. One end of the intermediate beam 112 is coupled to the first semi-arch beam via one hinge 19, and the other end of the intermediate beam 112 is coupled to the second semi-arch beam 111 via the other hinge 19. The double-hinge seat 75 is fixed to a lower part of the intermediate beam 112, wherein one end of the double-hinge seat 75 is coupled to the first slant support jack 73 via a hinge, and the other end of the double-hinge seat 75 is coupled to the second slant support jack 74 via a hinge.

An intermediate beam may be disposed. One front longitudinal beam may be disposed at an upper part of the intermediate beam. To be specific, one front longitudinal beam is disposed at an upper part just in the middle of the support canopy to support wall rock at a top part just in the middle of the tunnel.

Figure 12:
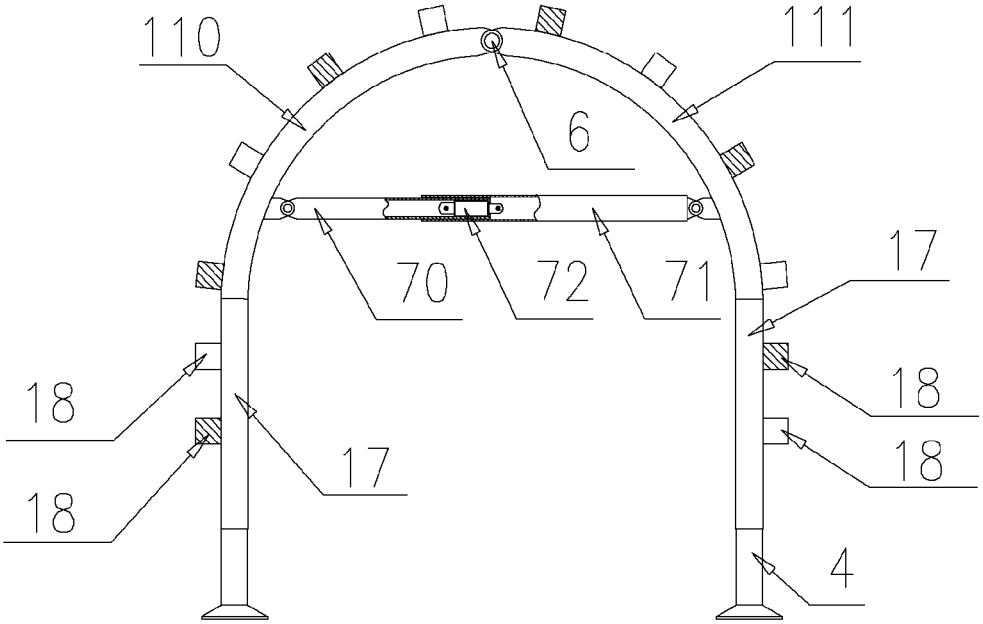
FIG. 12 is a schematic structural view of a self-moving tunnel support canopy with a side-wall protection beam according to an embodiment of the present invention.

Referring to FIG. 11 and FIG. 12, preferably, side wing beams 17 are provided on downward extension portions at two ends of the front arch beam 11, wherein the side wing beam 17 is provided with a side-wall protection beam 18. The rear arch beam 21 is of the same structure as the front arch beam 11, wherein the side wing beams 17 are also provided on downward extension portions at two ends of the rear arch beam 21, wherein the side wing beam 17 is also provided with the side-wall protection beam 18.

According to the present invention, the arch beam may be downwardly extended and elongated based on that illustrated in FIG. 3, either linear elongation or curved elongation. An outer side of the elongated section of the arch beam is fixed to a longitudinal bar-shaped long beam, i.e., a longitudinal side-wall protection beam. Dimensions of the side-wall protection beam may be the same as those of the front longitudinal beam. The downwardly elongated front arch beam and the side-wall protection beam protect the two sides, such that the arch support canopy protects two side walls of the tunnel in addition to supporting the top portion of the tunnel. Therefore, a self-moving support device capable of supporting one side (the top portion) and guarding two sides (the two side walls) is implemented. In this way, the self-moving arch tunnel support canopy is capable of supporting wall rock on one side and guarding wall rock on two sides of the tunnel. This frame form, during use in the tunnel, is capable of effectively preventing dangers and damages caused by slide and falloff of the rock from two side tops and two side walls to human and devices, Which achieves a better effect for the tunnel where the wall rock at the top portion is crushed but the wall rock on the two side is stable. With respect to a tunnel where the working surface with the wall rock on the three sides are all crushed and not stable, the arch beam having the first hinge, the spring board or the intermediate beam may be used. The arch beam is further provided with the telescopic beam 7, and is also provided with side wing beams 17 and side-wall protection beams 18. In this way, the support canopy according to the present invention actively supports the three sides of the tunnel (referring to FIG. 10, FIG. 11, and FIG. 12).

The present invention also implements a great forward step distance for the support canopy, as long as the stroke of the forward mechanism permits. The great step distance may be implemented by increasing the spacing between the front arch beam and the rear arch beam. In this way, the support canopy achieves a high forward speed, and thus single-cycle excavation capacity in the tunnel is increased and the construction speed is enhanced.

The longitudinal beam of the support canopy according to the present invention may be fabricated into short sections, wherein two ends of each short section may be fabricated into hinge structures that can be interconnected to each other. The short sections are convenient for transportation, and may be interconnected and spliced to a very long section for use in a tunnel requiring long-distance support.

The frame form as illustrated in FIG. 9 is used as an example for describing the moving method of the self-moving tunnel support canopy and functions of various parts thereof.

Figure 13A:
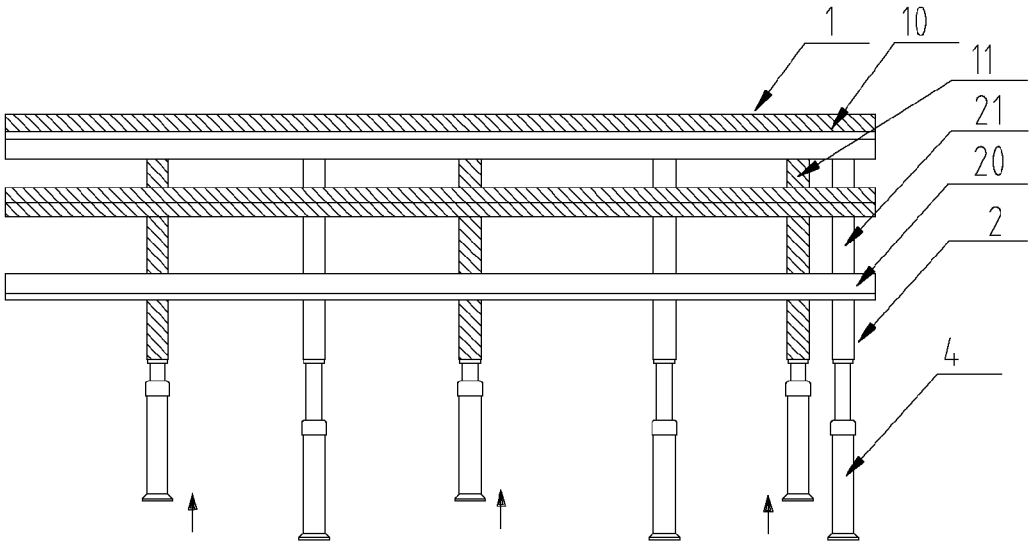
FIG. 13*a* is a schematic view of a first forward step in the self-moving tunnel support canopy according to an embodiment of the present invention.

1. Referring to FIG. 13*a*, when the support canopy is ready, all the support jacks 4 on the front arch frame 1 are pulled up, such that the columnar feet are detached from the bottom board, and in this case the support force provided against the wall rock on the top portion is released. The lateral jack inside the telescopic beam acts such that the extension beam contracts and the support force given against the side top is cancelled. In this case, the front longitudinal beam 10 longitudinally disposed on the top portion of the front arch frame 1 falls on the top portion of the rear arch beam 21 laterally disposed on the rear arch frame 2. Then, the rear arch frame 2 supports the wall rock on the top portion and the side top of the tunnel. In addition, the rear arch frame also bears the front arch frame 1 and various devices on the front arch frame 1.

Figure 13B:
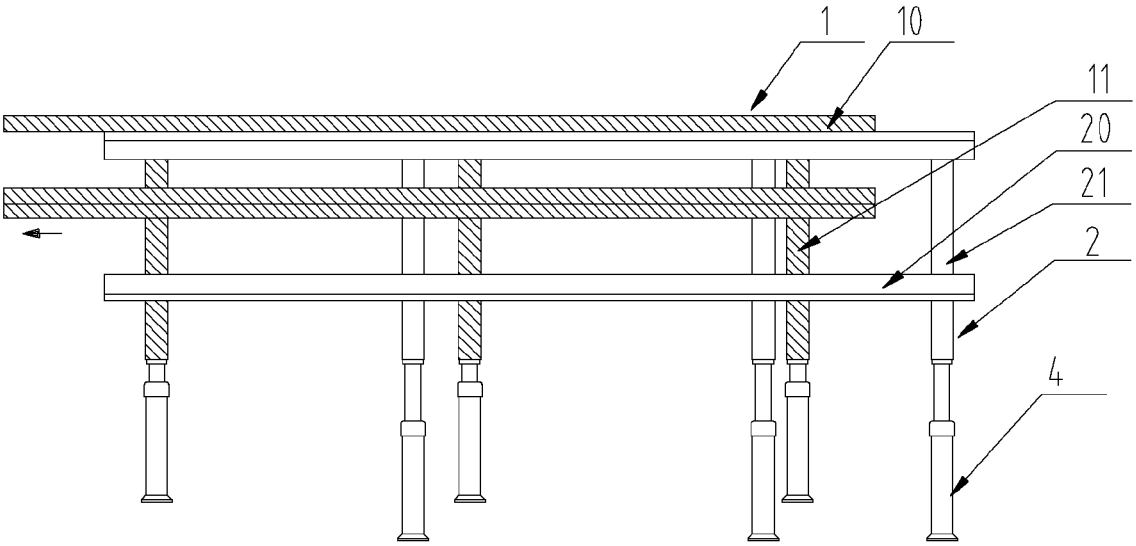
FIG. 13*b* is a schematic view of a second forward step in the self-moving tunnel support canopy according to an embodiment of the present invention.

2. Referring to FIG. 13*b*, the forward jack extends, and pushes the front arch frame 1 such that the front arch frame 1 drives all the device coupled thereto to move forward by one step distance.

Figure 13C:
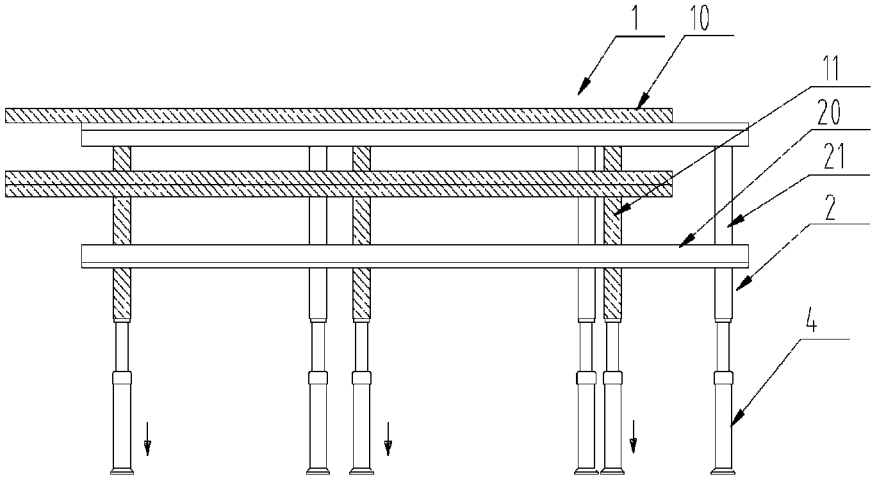
FIG. 13*c* is a schematic view of a third forward step in the self-moving tunnel support canopy according to an embodiment of the present invention.

3. Referring to FIG. 13*c*, the support jacks 4 on the front arch frame 1 are dropped down, such that the front arch frame 1 is raised to well support the wall rock on the top portion. The telescopic beam extends such that two wings of the front arch frame are in contact with two side tops. In this way, the two side tops are supported by the lateral jacks inside the telescope beam. Hence, the front arch frame moves forward successfully.

Figure 13D:
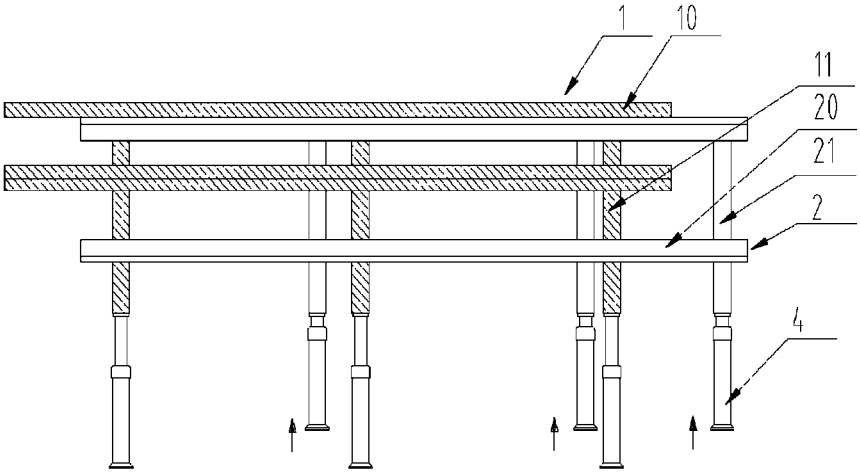
FIG. 13*d* is a schematic view of a fourth forward step in the self-moving tunnel support canopy according to an embodiment of the present invention.

4. Referring to FIG. 13*d*, all the support jacks 4 on the rear arch frame 2 are pulled up such that the rear arch frame 2 is unloaded against the top portion. The telescopic beam contracts such that two wings of the front arch frame are unloaded against the side tops. In this case, the rear longitudinal beam 20 on the rear arch frame 2 is detached from the wall rock on the top portion, and falls on the front arch beam 11 on the front arch frame 1. In this case, the front arch frame 1 supports the wall rock on the top portion and the side top and all the devices carried on the rear arch frame 2.

Figure 13E:
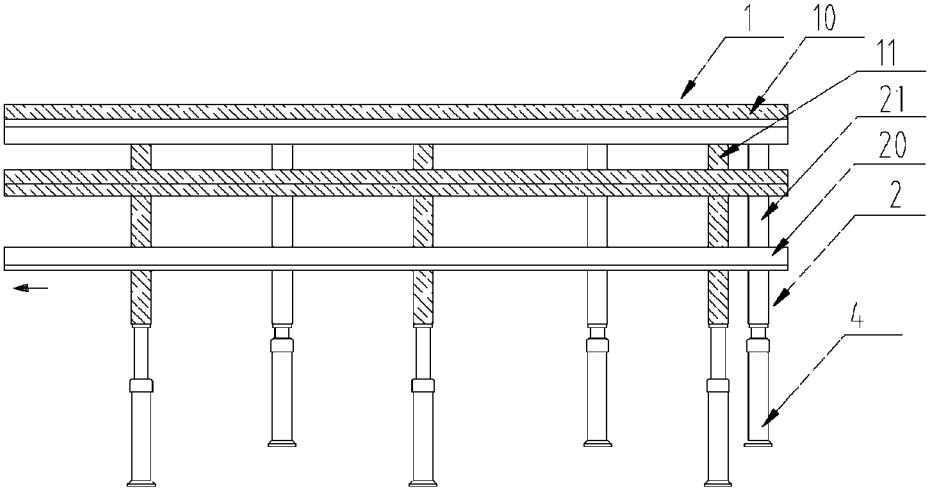
FIG. 13*e* is a schematic view of a fifth forward step in the self-moving tunnel support canopy according to an embodiment of the present invention.

5. Referring to FIG. 13*e*, the forward jack contracts and the rear arch frame 2 and all the devices carried on the rear arch frame 2 are moved forward by one step distance. The front end of the rear arch frame 2 is aligned with the front end of the front arch frame 1.

Figure 13F:
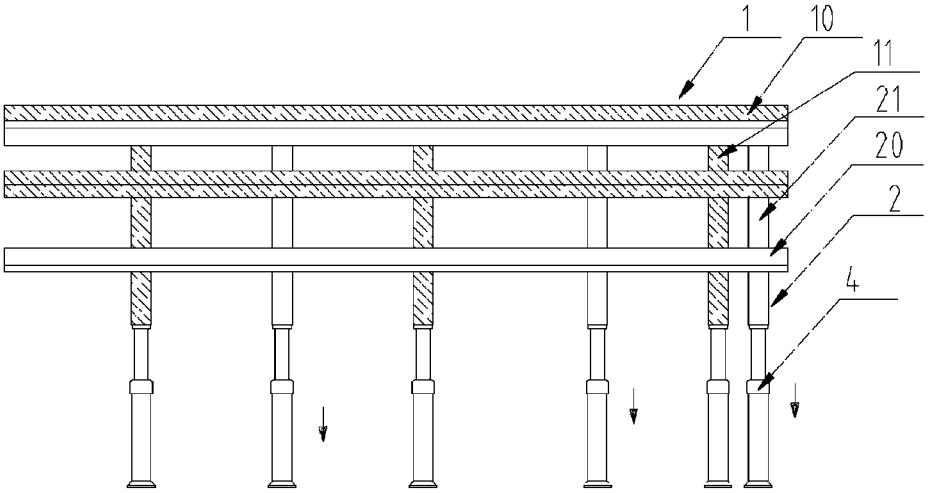
FIG. 13*f* is a schematic view of a sixth forward step in the self-moving tunnel support canopy according to an embodiment of the present invention.

6. Referring to FIG. 13*f*, all the support jacks 4 on the rear arch frame 2 are dropped down to well support the wall rock on the top portion, the telescopic beam on the rear arch frame 2 extends to left-and-right raise the two wings of the rear arch frame 2, such that the rear longitudinal beams on the outer sides of the two wings provide a support force against the side tops. In this way, the top portions of the tunnel are all supported. Here all the actions of the support canopy have been completed. The telescopic beam is to stabilize the support canopy and provides a support force to the two side tops.

Figure 14:
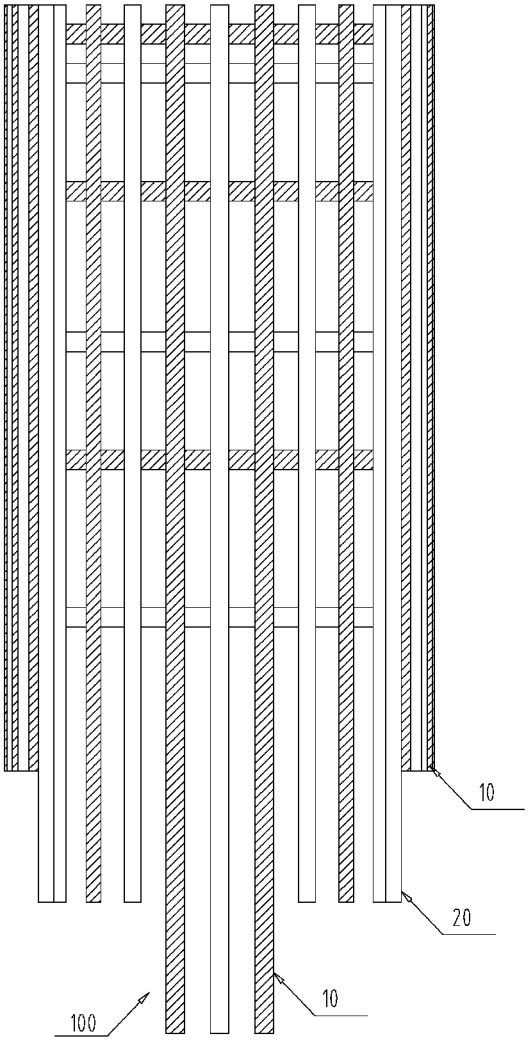
FIG. 14 is a top view of a step-like self-moving tunnel support canopy according to an embodiment of the present invention.

Preferably, referring to FIG. 14, based on FIG. 1, when the front arch frame 1 and the rear arch frame 2 are parellelly disposed, the front longitudinal beams 10 and the rear longitudinal beams 20 that are parallelly disposed are divided into at least two groups, wherein the at least two groups of longitudinal beams at least comprise a group of step-like longitudinal beams formed by two groups of longitudinal beams, each group of longitudinal beams at least comprising one front longitudinal beam 10 and one rear longitudinal beam 20.

At least one group of step-like longitudinal beams is configured. During the step method excavation construction in the tunnel, the group of step-like longitudinal beams may be subject to construction section by section. With this structure, multiple sections of wall rock may be supported and guarded.

Figure 15:
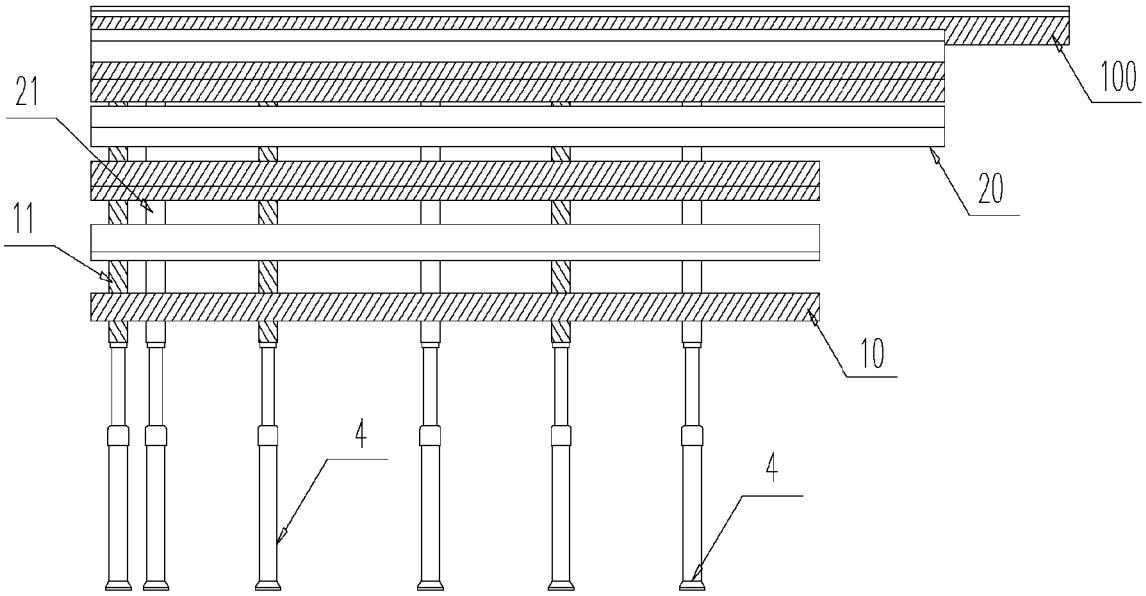
FIG. 15 is a side view of the step-like self-moving tunnel support canopy.

Referring to FIG. 14 and FIG. 15, based on the above embodiment, a step-like self-moving tunnel support canopy is configured, which comprises at least three groups of longitudinal beams. The front longitudinal beam 10 and the rear longitudinal beam 20 parallelly disposed at the uppermost end form a first group of longitudinal beams 100, wherein the first group of longitudinal beams 100 may comprise two front longitudinal beams 10 and one rear longitudinal beam 20. The other groups of longitudinal beams are symmetrically disposed on two sides of the first group of longitudinal beams 100 with the first group of longitudinal beams 100 as a center of symmetry. Front ends of the first group of longitudinal beams 100 are the longest, and front ends of each of the groups of longitudinal beams on the two sides are gradually shortened. On the two sides of the first group of longitudinal beams 100, front ends of any two adjacent groups of longitudinal beams form a step-like structure.

According to this embodiment, a step-like structure is formed on the front end of each of the adjacent groups of longitudinal beams, and all the longitudinal beams are left-to-right symmetrically divided into several step-like structures. Two front longitudinal beams and one rear longitudinal beam form a first group of longitudinal beams at the uppermost portion of the arch beam, i.e., the middle portion. The highest first group of longitudinal beams at the middle portion has longer front ends that the other groups, which is the uppermost end of the step-like longitudinal beam and also the frontmost end thereof. A second group of longitudinal beams and a third group of longitudinal beams are symmetrically disposed on two sides of the first group of longitudinal beams with the first group of longitudinal beams as an axis of symmetry. The other groups of longitudinal beams have shorter front ends that the first group of longitudinal beams. The second group of longitudinal beams and the third group of longitudinal beams form a step-like structure together with the first group of longitudinal beams. A fourth group of longitudinal beams and a fifth group of longitudinal beams are sequentially disposed on an outer side of the second group of longitudinal beams and the third group of longitudinal beams, and the fourth group of longitudinal beams and the fifth group of longitudinal beams have shorter front ends than that of the second group of longitudinal beams and the third group of longitudinal beams. The fourth group of longitudinal beams and the fifth group of longitudinal beams form a step-like structure together with the second group of longitudinal beams and the third group of longitudinal beams, and other groups of longitudinal beams are sequentially disposed on the fourth group of longitudinal beams and the fifth group of longitudinal beams such that any two adjacent groups of longitudinal beams form a step-like structure therebetween. Finally, an entire multi-step-like structure is formed. The longitudinal beams on two outmost sides have the shortest front ends, each group of the longitudinal beams are elongated gradually and sequentially. In the step-like structure according to the present invention, each group of longitudinal beams may be divided into multiple sections during the step method excavation construction in the tunnel, which support and guard the multiple sections of wall rock.

Described above are merely preferred embodiments of the present invention, but are not intended to limit the present invention. Any modification, equivalent replacement, or improvement made without departing from the spirit and principle of the present invention should fall within the protection scope of the present invention.

What is claimed is:

1. A self-moving tunnel support canopy, comprising a front arch frame, a rear arch frame, a forward jack, and a support jack; wherein: the front arch frame comprises more than three front longitudinal beams and more than three front arch beams, all the front longitudinal beams being longitudinally disposed along arch upper surfaces of the front arch beams, each of the front longitudinal beams being coupled to all the front arch beams, the support jack being disposed at a lower part of the front arch frame; the rear arch frame comprises more than three rear longitudinal beams and more than three rear arch beams, all the rear longitudinal beams being longitudinally disposed along arch upper surfaces of the rear arch beams, each of the rear longitudinal beams being coupled to all the rear arch beams, the support jack being disposed at a lower part of the rear arch frame, the front longitudinal beams and the rear longitudinal beams being disposed alternately, and a spacing being configured between the front arch beam and a front-adjacent rear arch beam; and one end of the forward jack is coupled to the front arch frame, and the other end of the forward jack is coupled to the rear arch frame, the front arch beam and the rear arch beam being both arch-shaped beams.

2. The self-moving tunnel support canopy according to claim 1, wherein the front arch beam comprises a first semi-arch beam and a second semi-arch beam, the first semi-arch beam and the second semi-arch beam being oppositely disposed to form an arch beam, the first semi-arch beam being coupled to the second semi-arch beam via a coupling member, the coupling member being capable of enabling the first semi-arch beam and the second semi-arch beam to contract towards inner sides thereof, or extend towards outer sides thereof at a specific angle under action of an external force; and the front arch beam is of the same structure as the rear arch beam.

3. The self-moving tunnel support canopy according to claim 2, wherein: the coupling member is a spring board, an intermediate portion at an upper end of the first semi-arch beam is provided with an opening, and an intermediate portion at an upper end of the second semi-arch beam is provided with an opening, one end of the spring board being inserted into the opening at the intermediate portion of the first semi-arch beam, the other end of the spring board being inserted into the opening at the intermediate portion of the second semi-arch beam, and the spring board being fixedly coupled to the first semi-arch beam and the second semi-arch beam via a pin shaft.

4. The self-moving tunnel support canopy according to claim 2, wherein the coupling member is a first hinge.

5. The self-moving tunnel support canopy according to claim 4, wherein arch inner sides of the first semi-arch beam and the second semi-arch beam are provided with a telescopic beam, one end of the telescopic beam being coupled to the first semi-arch beam and the other end of the telescopic beam being coupled to the second semi-arch beam.

6. The self-moving tunnel support canopy according to claim 5, wherein: the telescopic beam comprises a small lateral beam and a large lateral beam, one end of the small lateral beam being inserted inside the large lateral beam, and the other end of the small lateral beam being coupled to a hinge seat on the inner side of the first semi-arch beam via a hinge; and the telescopic beam is internally provided with a lateral jack, one end of the lateral jack being hinged to the small lateral beam, the other end of the lateral jack being hinged to the large lateral beam, one end of the large lateral beam being coupled to a hinge seat on the inner side of the second semi-arch beam via a hinge.

7. The self-moving tunnel support canopy according to claim 5, wherein the telescopic beam comprises a first slant support jack and a second slant support jack, one end of the first slant support jack being coupled to a hinge seat on the inner side of the first semi-arch beam via a hinge, the other end of the first slant support jack being coupled to a double-hinge seat, the double-hinge seat being coupled to the coupling member, one end of the second slant support jack being coupled to a hinge seat on the inner side of the second semi-arch beam, and the other end of the second slant support jack being coupled to the double-hinge seat.

8. The self-moving tunnel support canopy according to claim 2, wherein the coupling member comprises an intermediate beam and two hinges, one end of the intermediate beam being coupled to the first semi-arch beam via one hinge, and the other end of the intermediate beam being coupled to the second semi-arch beam via the other hinge.

9. The self-moving tunnel support canopy according to claim 8, wherein arch inner sides of the first semi-arch beam and the second semi-arch beam are provided with a telescopic beam, one end of the telescopic beam being coupled to the first semi-arch beam and the other end of the telescopic beam being coupled to the second semi-arch beam.

10. The self-moving tunnel support canopy according to claim 9, wherein: the telescopic beam comprises a small lateral beam and a large lateral beam, one end of the small lateral beam being inserted inside the large lateral beam, and the other end of the small lateral beam being coupled to a hinge seat on the inner side of the first semi-arch beam via a hinge; and the telescopic beam is internally provided with a lateral jack, one end of the lateral jack being hinged to the small lateral beam, the other end of the lateral jack being hinged to the large lateral beam, one end of the large lateral beam being coupled to a hinge seat on the inner side of the second semi-arch beam via a hinge.

11. The self-moving tunnel support canopy according to claim 9, wherein the telescopic beam comprises a first slant support jack and a second slant support jack, one end of the first slant support jack being coupled to a hinge seat on the inner side of the first semi-arch beam via a hinge, the other end of the first slant support jack being coupled to a double-hinge seat, the double-hinge seat being coupled to the coupling member, one end of the second slant support jack being coupled to a hinge seat on the inner side of the second semi-arch beam, and the other end of the second slant support jack being coupled to the double-hinge seat.

12. The self-moving tunnel support canopy according to claim 1, wherein side wing beams are provided on downward extension portions at two ends of both the front arch beam and the rear arch beam, the side wing beams being each provided with a side-wall protection beam.

13. The self-moving tunnel support canopy according to claim 12, wherein: one end of the forward jack is coupled to the front arch beam, and the other end of the forward jack is coupled to the rear arch beam; and the support jack is disposed below the sides of front arch beam and the rear arch beam.

14. The self-moving tunnel support canopy according to claim 1, wherein when the front arch frame and the rear arch frame are disposed in parallel, the front longitudinal beams and the rear longitudinal beams that are disposed in parallel are divided into at least two groups of longitudinal beams, the at least two groups of longitudinal beams at least comprising a group of step-like longitudinal beams formed by two groups of longitudinal beams, each group of longitudinal beams at least comprising one front longitudinal beam and one rear longitudinal beam.

15. The self-moving tunnel support canopy according to claim 14, comprising at least three groups of longitudinal beams, the front longitudinal beam and the rear longitudinal beam disposed in parallel at the uppermost end form a first group of longitudinal beams, the other groups of longitudinal beams are symmetrically disposed on two sides of the first group of longitudinal beams with the first group of longitudinal beams as a center of symmetry, front ends of the first group of longitudinal beams are the longest, and front ends of each of the groups of longitudinal beams on the two sides are gradually shortened to form a step-like structure.

* * * * *